US005570663A

United States Patent [19]

Shida

[11] Patent Number: 5,570,663

[45] Date of Patent: Nov. 5, 1996

[54] VALVE ROTATOR

[75] Inventor: Toshimitsu Shida, Fujisawa, Japan

[73] Assignee: Fuji Oozx, Inc., Japan

[21] Appl. No.: 516,810

[22] Filed: Aug. 18, 1995

[30] Foreign Application Priority Data

Aug. 29, 1994 [JP] Japan ..... 6-203922

[51] Int. Cl.[6] ..... F01L 1/32

[52] U.S. Cl. ..... 123/90.3; 123/188.11; 251/227

[58] Field of Search ..... 123/188.1, 188.11, 123/188.2, 90.28, 90.3, 90.29; 251/227

[56] References Cited

U.S. PATENT DOCUMENTS

| | | | |
|---|---|---|---|
| 1,341,134 | 5/1920 | Keller | 123/90.3 |
| 1,380,586 | 6/1921 | Pelletier . | |
| 1,381,223 | 6/1921 | Pelletier . | |
| 1,406,986 | 2/1922 | Keller | 123/90.3 |
| 1,850,544 | 3/1932 | Gray . | |
| 3,421,734 | 1/1969 | Updike et al. | 251/337 |
| 3,952,713 | 4/1976 | Tauschek | 123/90.3 |
| 4,003,353 | 1/1977 | Tauschek | 123/90.23 |
| 4,075,987 | 2/1978 | Tauschek et al. | 123/90.3 |
| 4,094,280 | 6/1978 | Updike | 123/90.3 |
| 4,141,325 | 2/1979 | Shalaty | 123/90.3 |
| 4,154,424 | 5/1979 | Cherrie | 251/337 |
| 4,227,493 | 10/1980 | Updike | 123/90.3 |
| 4,424,773 | 1/1984 | Wendel et al. | 123/90.3 |
| 4,538,558 | 9/1985 | Updike et al. | 123/90.3 |

FOREIGN PATENT DOCUMENTS

| | | | |
|---|---|---|---|
| 1121876 | 8/1956 | France | 123/90.29 |
| 2488328 | 2/1982 | France . | |
| 2411430 | 9/1975 | Germany | 123/90.3 |
| 2739403 | 3/1979 | Germany | 123/90.3 |
| 3149815A1 | 7/1983 | Germany . | |
| 586064 | 12/1958 | Italy | 123/90.3 |
| 60-067707 | 4/1985 | Japan . | |
| 2-110211 | 9/1990 | Japan . | |

*Primary Examiner*—Erick R. Solis
*Attorney, Agent, or Firm*—Graham & James LLP

[57] ABSTRACT

With vertical movement of a valve in an engine, a suspending member which suspends from a retainer engaged in the valve goes up and down with respect to a standing member on a cylinder head. A projection provided on the suspending member slides on inclined guide surfaces of the standing member, thereby attaining relative rotation of the suspending member forcibly with respect to the standing member, so that the valve is rotated on its axis.

5 Claims, 9 Drawing Sheets

VALVE ROTATOR

BACKGROUND OF THE INVENTION

The present invention relates to a valve rotator for rotating a valve around a shaft gradually during operation to change engagement of a valve face with a valve seat continuously, thereby making wear of the valve face uniform FIGS. 9 and 10 illustrate a conventional valve rotator as disclosed in Japanese Utility Mode Laid-Open Pub. No.2-110211. 1 denotes a cylinder head in an automobile engine, and 2 denotes a valve in which a valve spring 4 is provided between the cylinder head 1 and a retainer 3 of the upper end of a valve stem 2*a* of the valve 2. By pressing the upper end of the valve stem 2*a* of the valve 2 by a rocker arm 5 against upward biasing force of the valve spring 4, a valve face 2*c* of the lower end of the valve stem 3*a* is left from a valve seat 6 downwards to open a port 7.

In a conventional example as shown in FIGS. 9 and 10, the retainer 3 contains a rotator 8 for rotating the valve 2. The retainer 3 comprises a rotator body 10 which is engaged with the upper end of the valve stem 2*a* of the valve 2 via a cotter 9; a spring retainer 11 which is fitted under the valve body 10; a ball 12: a spring 13; a ball race 14 and a leaf spring 15. Whenever the valve 2 ascends and descends, the rotator body 10 and the spring retainer 11 are relatively rotated, thereby rotating the valve 2 gradually. The details are disclosed in Japanese Utility Model Laid-Open Pub. No.2-110211. 16 denotes a valve guide, and 17 denotes sealing material at the upper end thereof.

However, in the conventional valve rotator, it is not clear whether or not the rotator is always rotated by one vertical reciprocating movement, and how long it rotates, thereby decreasing reliability, which is disadvantageous. The structure is very complicate and assembling thereof is troublesome.

SUMMARY OF THE INVENTION

In view of such disadvantages in the prior art, it is an object of the present invention to provide a valve rotator which enables a valve to rotate exactly, its structure being simple to facilitate assembling thereof.

According to the present invention, there is provided a valve rotator in which a valve spring is provided between a cylinder head and a retainer which is engaged with a projecting end of a valve, the valve being actuated against the valve spring to open and close a port, the rotator comprising a suspending member which suspends from an outer circumference of the retainer; and a standing member which is concentric to the valve and extends from the cylinder head to the retainer, the standing and suspending members being at least partially overlapped, a projection being provided on one of the suspending and standing members at the overlapped portion, guide means which comprise an inclined guide surface being slidably engaged on said projection to cause relative rotation between the suspending and standing members.

The following advantages of the present invention are achieved. By one reciprocating movement of the valve, rotational force is exactly applied to the valve, thereby enabling it to rotate gradually. The number of parts is significantly smaller than that of a conventional rotator, thereby simplifying the structure and descreasing cost for manufacturing.

BRIEF DESCRIPTION OF THE DRAWINGS

The above and other features and advantages of the present invention will become more apparent by detailed description with respect to the following drawings wherein.

DETAILED DESCRIPTION OF PREFERRED EMBODIMENTS

Figure 1:
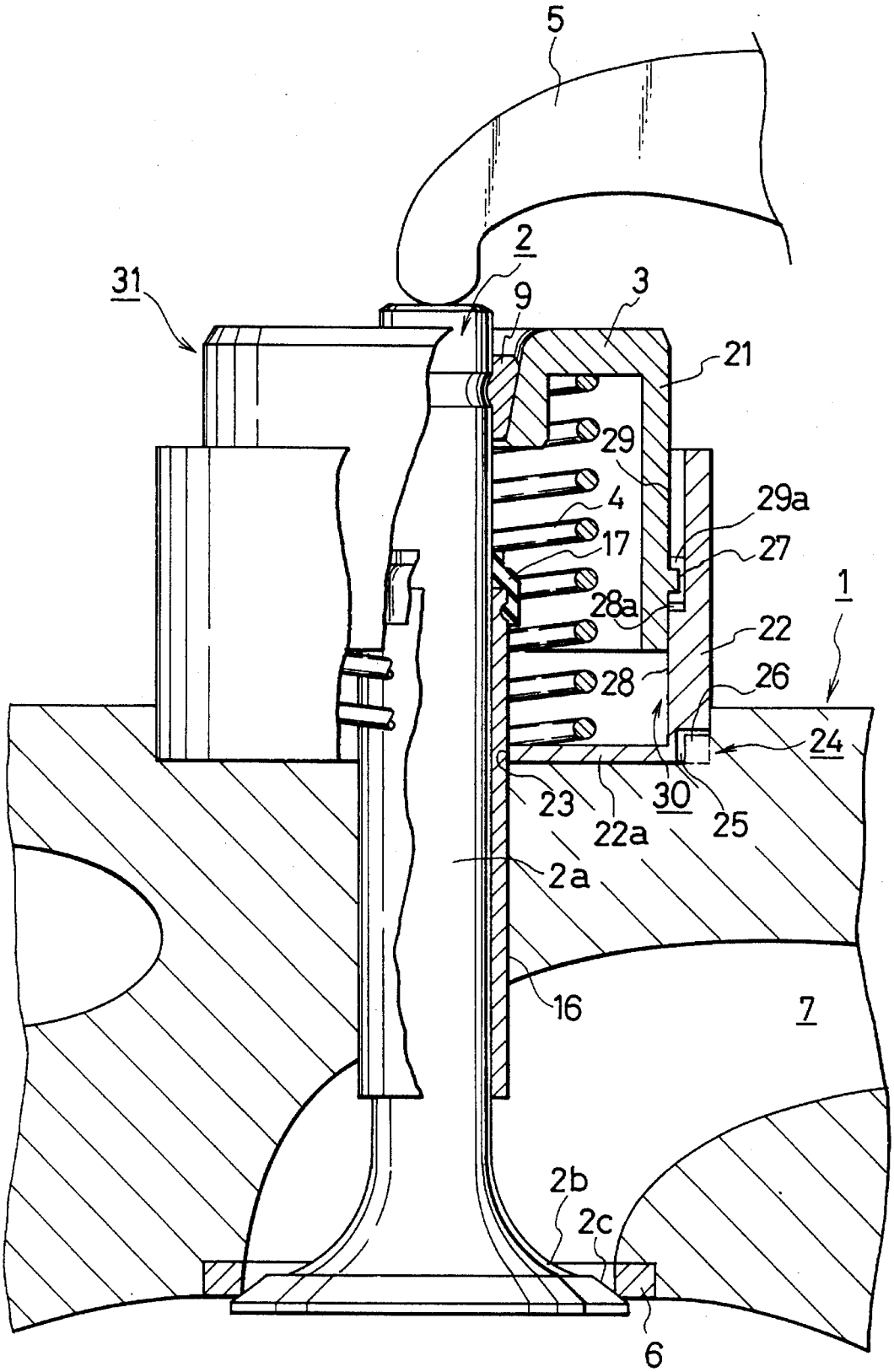
FIG. 1 is a partially cut-away longitudinal sectional front view of the first embodiment of the present invention.
Figure 2:
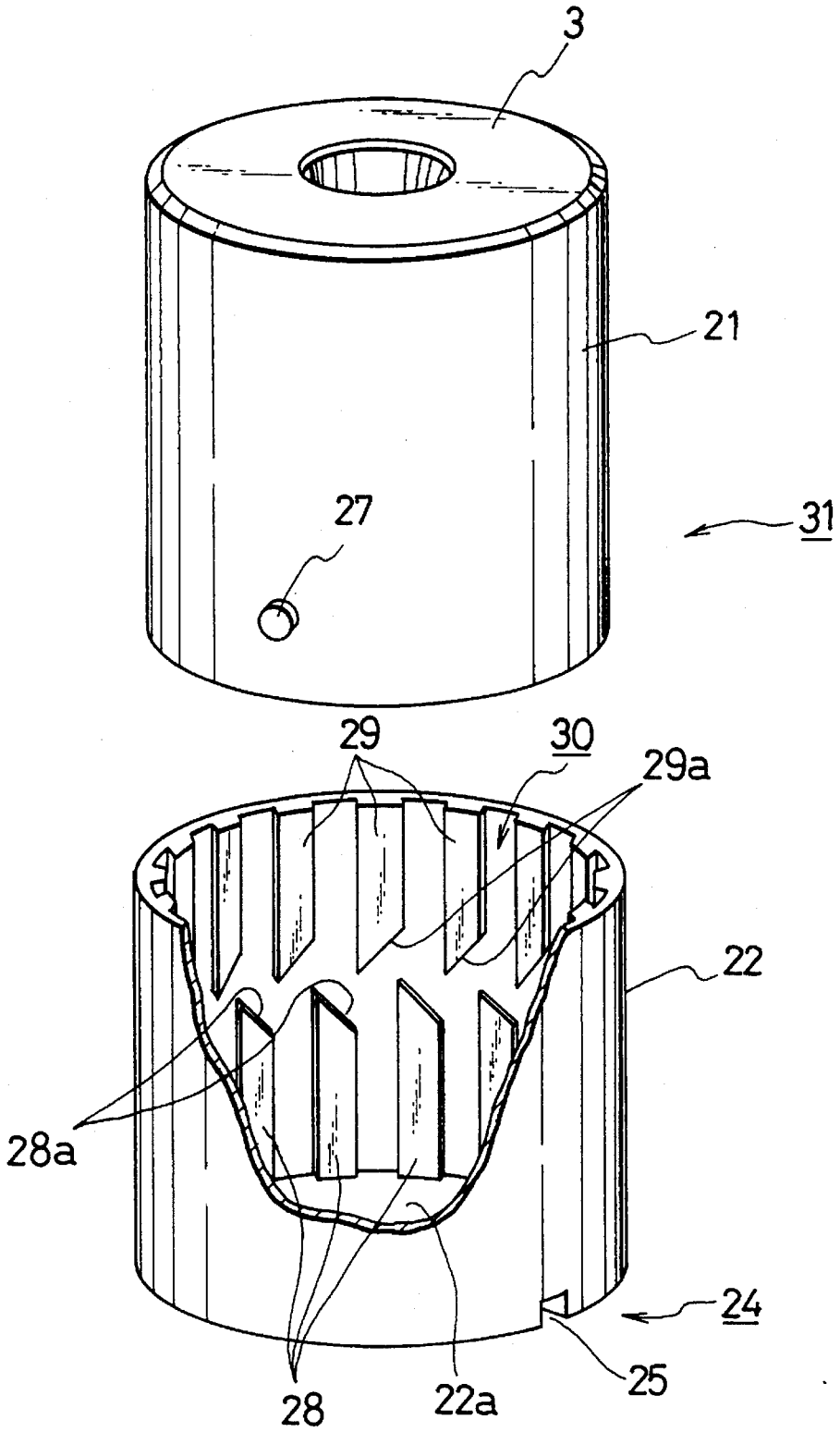
FIG. 2 is a partially cut-away perspective view of the main portion thereof.
Figure 3:
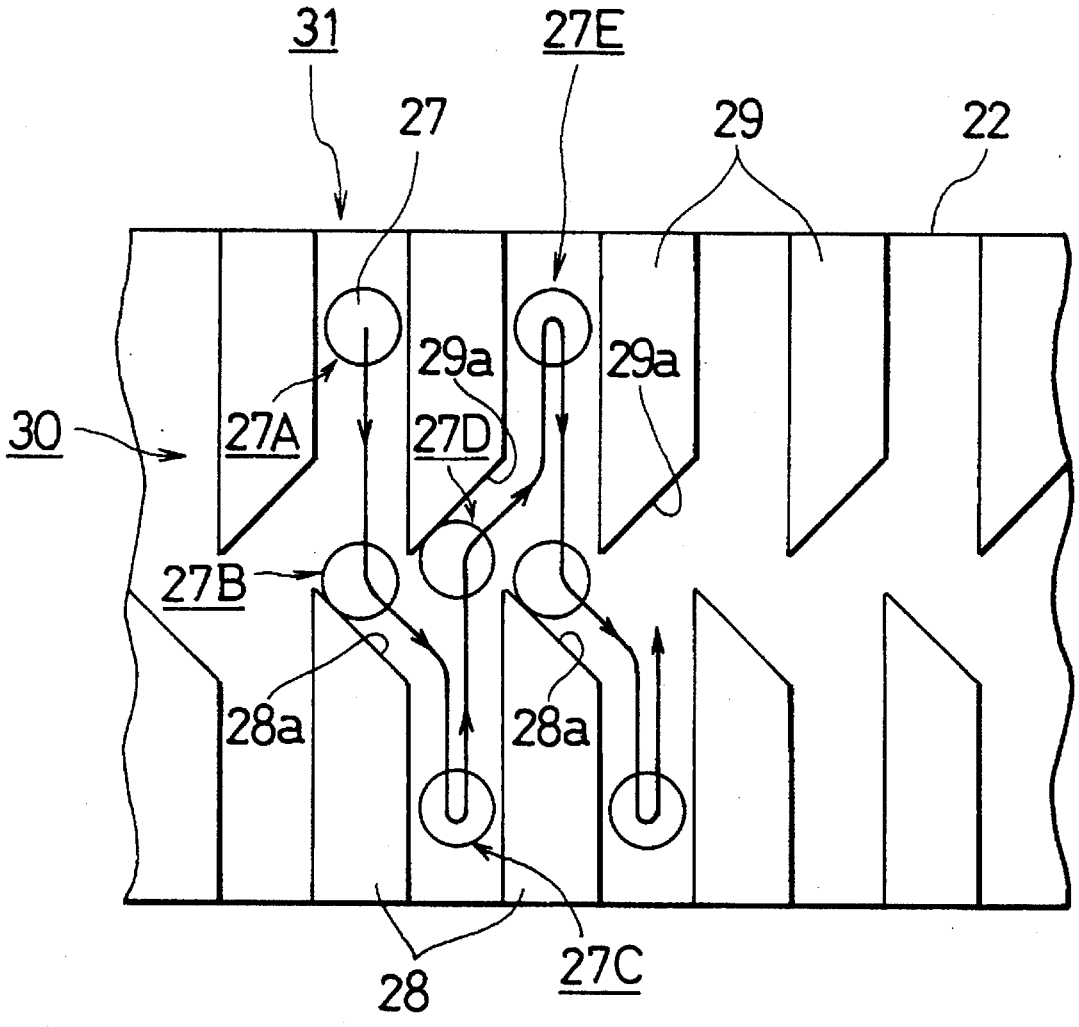
FIG. 3 is a development thereof.

FIGS. 1 to 3 show the first embodiment in which the present invention is applied to low speed engines used in ships. The same numerals are allotted to the same members as those in the conventional rotator as described above.

A retainer 3 which is engaged in a valve 2 by a cotter 9 is formed as a disc and has a suspending member 21 which suspends from the outer circumference thereof. Around the suspending member 21, there is provided a standing member 22 which projects from a cylinder head 1 to a retainer 3 and is concentric to the valve 2. The lower end of the standing member 22 is closed by a bottom wall 22*a*. In the middle of the bottom wall 22*a*, there is formed an opening 23 through which a valve guide 16 is held. The valve guide 16 surrounds a valve stem 2*a* of the valve 2. The bottom wall 22*a* is held between the lower end of a valve spring 4 and the upper surface of the cylinder head 1 and supports the valve spring 4.

24 denotes rotation stopper means for preventing rotation of the standing member 22 around the valve 2, and comprises a groove 25 at the lower outer circumference of the bottom wall 22*a* of the standing member 22 and a protrusion 28 of the cylinder head 1, the protrusion being engaged in the groove 25.

On one of the suspending and standing members 21 and 22, in this embodiment, on the outer circumferential surface of the suspending member 21, there is provided at least one, preferably, more than one pin-like projection 27. If they are a plurality of the projections, they are provided at regular intervals on the circumference.

On the other of the suspending and standing members 21 and 22, in this embodiment, on the inner surface of the cylindrical portion 22, there is provided guide means 32 which alternately comprises first and second protuberances 28 and 29, the first protuberance 28 having an inclined guide surface 28*a* which is slidably engaged on the projection 27, when the retainer 3 is lowered, to rotate the suspending member 21 forcibly around the axis of the valve 2, the second protuberance 29 having an inclined guide surface 29*a* which is slidably engaged with the projection 27, when the retainer 2 rises, to rotate the suspending member 21 forcibly around the axis of the valve 2.

The first protuberances 28 are axially formed like a spline downwards from the middle portion of the standing member 22, and the second protuberances 29 are axially formed like a spline upwards from the middle portion. The thickness of the protuberances 28 and 29 on the inner surface of the cylindrical member 22 is greater than that of the projection 27 on the outer circumferential surface of the cylindrical surface, and the outer circumferential surface of the suspending member 21 is slidably engaged on the inner circumferential surface of the protuberances 28 and 29. A rotator 31 comprises the suspending member 21 which has the projections 27, and the standing member 22 which has the guide means 30.

The operation by this embodiment will be described with respect to FIG. 3. When the valve 2 is opened as shown in FIG. 1, it is presumed that the projection 27 is positioned in a position 27A in FIG. 3. From this situation, the valve 4 is lowered by the rocker arm 5 against biasing force of the valve spring 4, and the retainer 3 is lowered together with the suspending member 21 and the projection 27. When the projection 27 comes to the position 27B in which the projection 27 is engaged with the inclined guide surface 28*a* of the first protuberance 28, the projection 27 along the inclined guide surface 28*a* downwards and rightwards in FIG. 3. The standing member 22 is prevented from rotation by the Potation stopper means 24 with respect to the cylinder head 1, and thus, the suspending member 21, the retainer 3 and the valve 2 is forcibly rotated by moving distance of the projection 27 rightwards.

The projection 27 is left from the inclined guide surface 28*a*, and the projection 27 is lowered. When the valve reaches to the lower limit (fully opened), the projection 27 reaches to the position 27C in FIG. 3, and then, rises with the valve 2.

On the way of elevation, when the projection 27 reaches to the position 27D in which it is engaged with the inclined guide surface 29*a* of the second protuberance 29, the projection 27 is moved rightwards and upwards along the inclined guide surface 29*a* thereafter. On the basis of similar principle wherein it passes through the position 27B duping lowering as mentioned above, the valve 2 is rotated forcibly by roughly equal distance in the same direction.

The projection 27 is left from the inclined guide surface 29*a*, and rises. When the valve 2 reaches to the upper limit (fully opened), the projection 27 reaches to a position 27E having equal height to the position 27A and deviated by a certain pitch in a circumferential direction.

Thereafter, with lowering and elevation of the valve 2, the projection 27 repeats similar movement to the above movement of the positions 27A to 27E, and the valve 2 is rotated forcibly and exactly at a pitch similar to the above pitch. Therefore, there is no possibility of variation in rotation of the valve 2, thereby achieving uniformity in wear of the valve.

Figure 4:
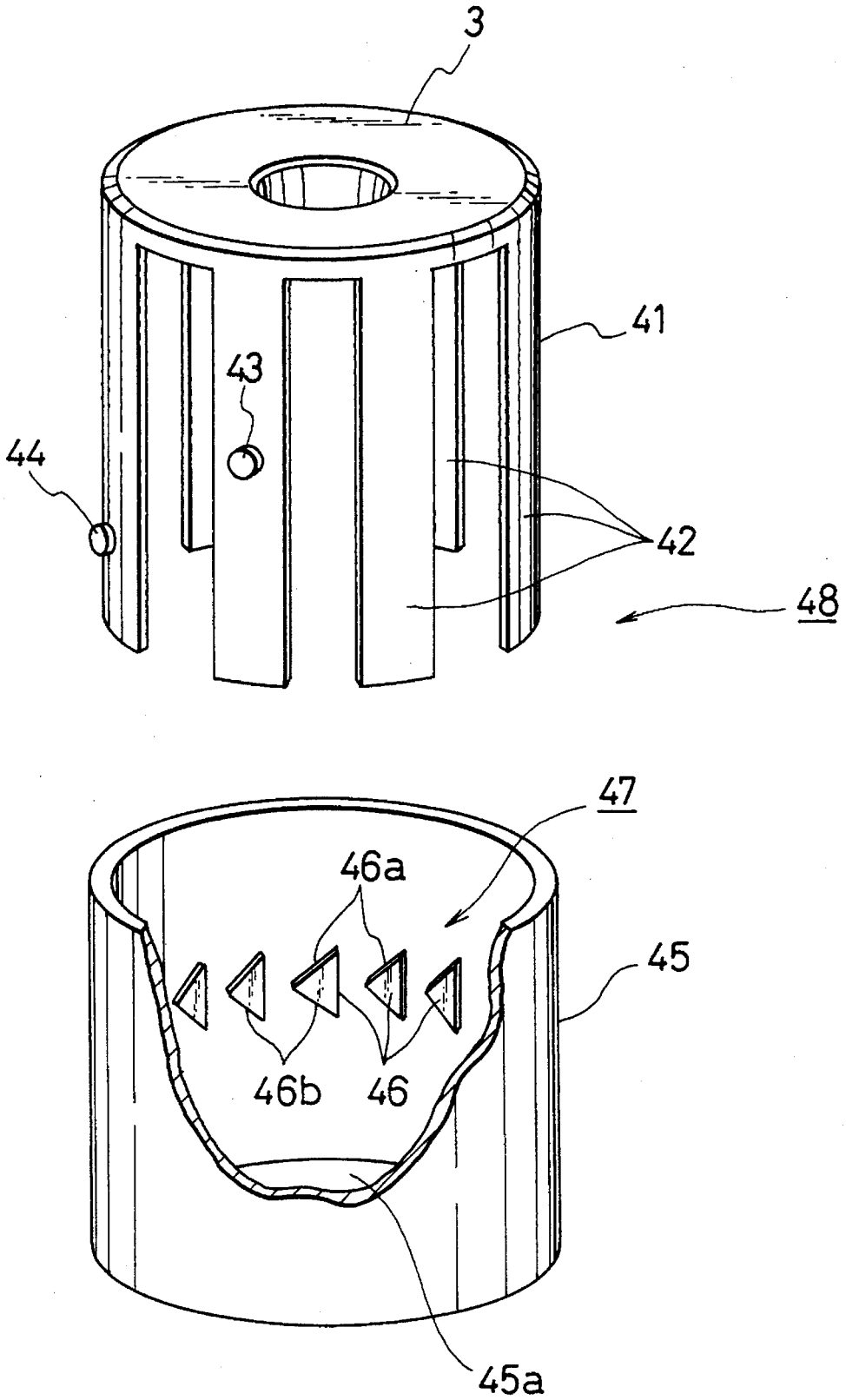
FIG. 4 is a partially cut-away perspective view of the main portion of the second embodiment.
Figure 5:
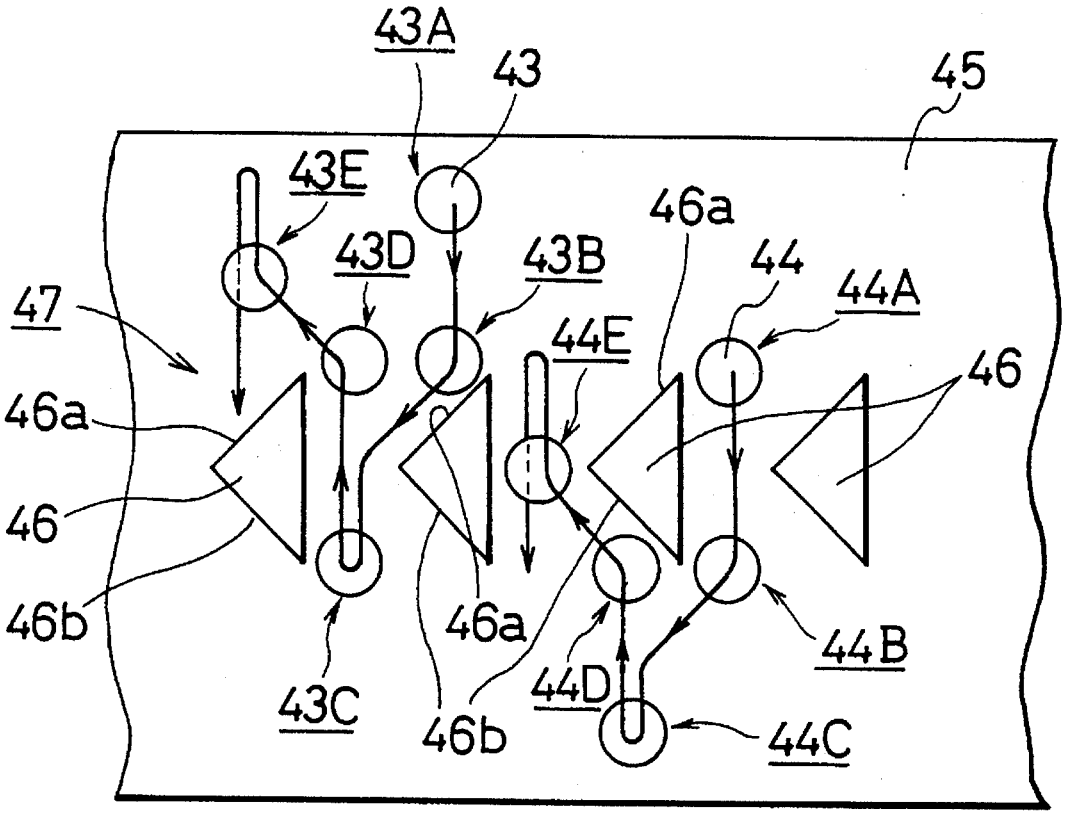
FIG. 5 is a development of the main portion.

FIGS. 4 and 5 illustrate the second embodiment, in which the same numerals are allotted to the same portions as those in the first embodiment and detailed description therefor is omitted.

In the second embodiment, a suspending member 41 comprises a plurality of axially extending arcuate sectioned plates 42 spaced at equal distance in a circumferential direction, the plates 42 suspending from the outer circumference of the retainer 3. On the outer circumferential surface of any of the plates, there are provided at least two, preferably four or six, pin-like projections 43 and 44 having different height.

On the inner circumferential surface of a bottom-having standing member 45 similar to the standing member 22 in the first embodiment, there are provided a plurality of triangular protuberances 46 which has a first upper inclined guide surface 46*a* and a second lower inclined guide surface 46*b*, the first guide surface being slidably engaged with the upper projection 43 (first projection) during lowering of the retainer 3 to cause relative rotational force between the suspending and standing members 41 and 45, the second guide surface being engaged with the lower projection 44 (second projection) during elevation of the retainer 3 to cause relative rotational force between the suspending and standing members 41 and 45.

The distance between the two adjacent protuberances 48 is slightly larger than the diameter of each of the projections 43 and 44. The circumferential distance between the first and second projections 43 and 44 is defined such that one of the projections 43 and 44 is provided between the two adjacent protuberances 48, the other being vertically fitted with any of the protuberances 46. The rotator 48 is made of the suspending member 41 which has the two projections 43 and 44 and the standing member 45 which has the guide means 45 comprising the plurality of protuberances 46. In the second embodiment, there is no member similar to the rotation stopper means 34 in the first embodiment. The standing member 45 is rotatably provided on the cylinder head.

In the second embodiment, as shown in FIG. 5, when the retainer 3 descends, the projections 43 and 44 descends from positions 43A and 44A to the positions 43B and 44B, and the first projection 43 is slidably engaged on a first inclined guide surface 46*a* of the protuberance 46 from the position 43B, thereby rotating the suspending and standing members 41 and 45 forcibly.

In the standing member 45, there is no means for preventing rotation with respect to the cylinder head, so that there is possibility that the standing member 45 could be rotated. Actually, in the standing member 45, there are downward force component that the first projection 43 presses the first inclined guide surface 46A downwards, and downward biasing force by a valve spring. Thus, owing to larger frictional resistant force between a bottom of the standing member 45 and the upper surface of the cylinder head, the standing member 45 is not rotated, but there is high possibility that the suspending member 41, the retainer 3 and the valve are rotated. The standing member 45 may be slightly rotated.

When the first projection 43 is left from the first inclined guide surface 48*a*, the projections 43 and 44 descends and reaches to positions 43C and 44C. On the way of elevation from the positions 43C and 44C, the projections 43 and 44 reaches to positions 43D and 44D, the second projection 44 is slidably engaged on a second inclined guide surface 45*b* of another protuberance 46, while the suspending and standing members 41 and 45 are forcibly rotated. This time, in the standing member 45, the upward force component that the second projection 44 presses the second inclined guide surface 48B upwards is offset by downward biasing force by the expanding valve spring, and frictional resistant force between a bottom 45A of the standing member 45 and the upper surface of the cylinder head is significantly smaller than the above, so that the standing member 45 rotates, while the suspending member 41, the retainer 3 and the valve is elevated without rotation or with slight rotation.

The second projection 44 is left from the second inclined guide surface 48b, and the projections 43 and 44 ascends and reaches to positions 43E and 44E which is as high as the positions 43A and 44A.

Thereafter, with descending and ascending of the valve, movement of the projections 43 and 44 from the positions 43A,44A to 43E,44E is repeated, and the projections 43 and 44 moves at a certain pitch towards the standing member 45 in a circumferential direction. The standing member 45 is not prevented from rotation with respect to the cylinder head, so that the valve is rotated at pitch slower than that of the first embodiment. Therefore, the second embodiment is suitable to apply to a high speed automobile engine. Of course, the second embodiment achieves advantages similar to that by the first embodiment.

Figure 6:
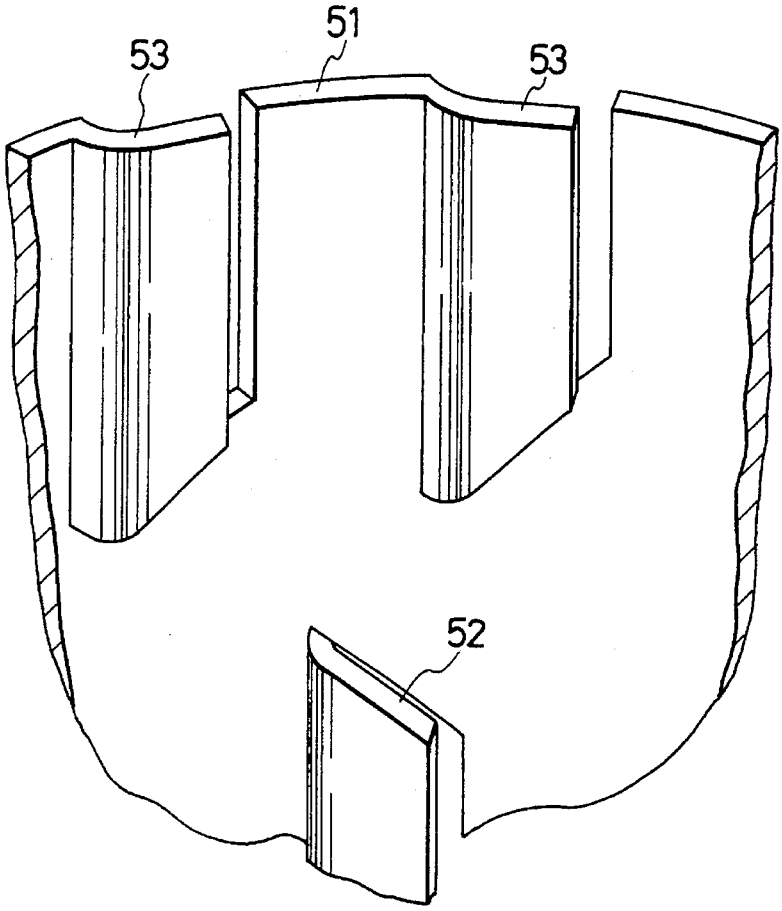
FIG. 6 is an enlarged perspective view of part of the third embodiment to which the first embodiment is partially modified.

FIG. 6 illustrates the third embodiment in which the first embodiment is partially modified. In this embodiment, a cylindrical standing member 51 is made of plate material, and first and second protuberances 52 and 53 similar to the first and second protuberances 28 and 29 in the first embodiment are formed by stamping and cutting the standing member 51, thereby facilitating processing of the standing member 51 and reducing manufacturing cost.

Figure 7:
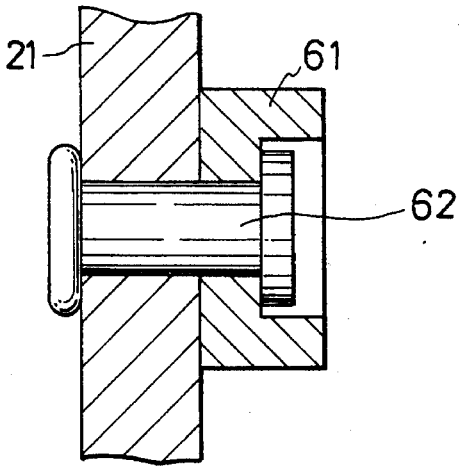
FIG. 7 is an enlarged longitudinal sectional front view of the fourth embodiment to which the first embodiment is partially modified.

FIG. 7 illustrates the fourth embodiment in which the first embodiment is partially modified. In this embodiment, instead of the pin-like projection 27 in the first embodiment, a roller 61 is mounted to the suspending member 21 by a shaft 62, so that the roller 61 is rotatably engaged on the inclined guide surface 28*a* of the first protuberance 28 and on the inclined guide surface 29*a* of the second protuberance 29 as shown in FIGS. 1 to 3. Thereby reducing friction and wear between the roller 61 and the inclined guide surfaces 28*a* and 29*a* and facilitating operation of the rotator.

Figure 8:
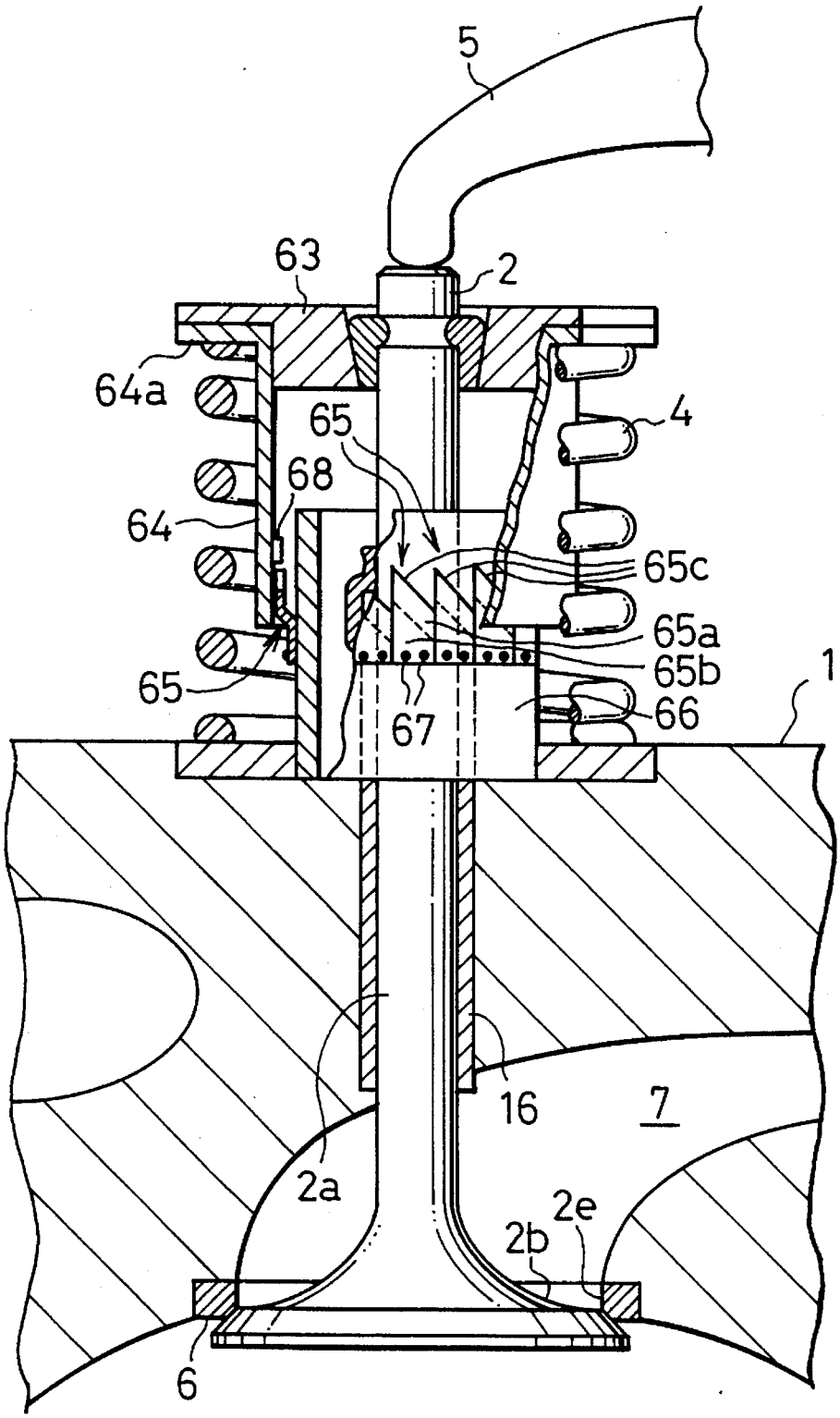
FIG. 8 is an enlarged longitudinal sectional front view of the fifth embodiment to which the first embodiment is partially modified.
Figure 9:
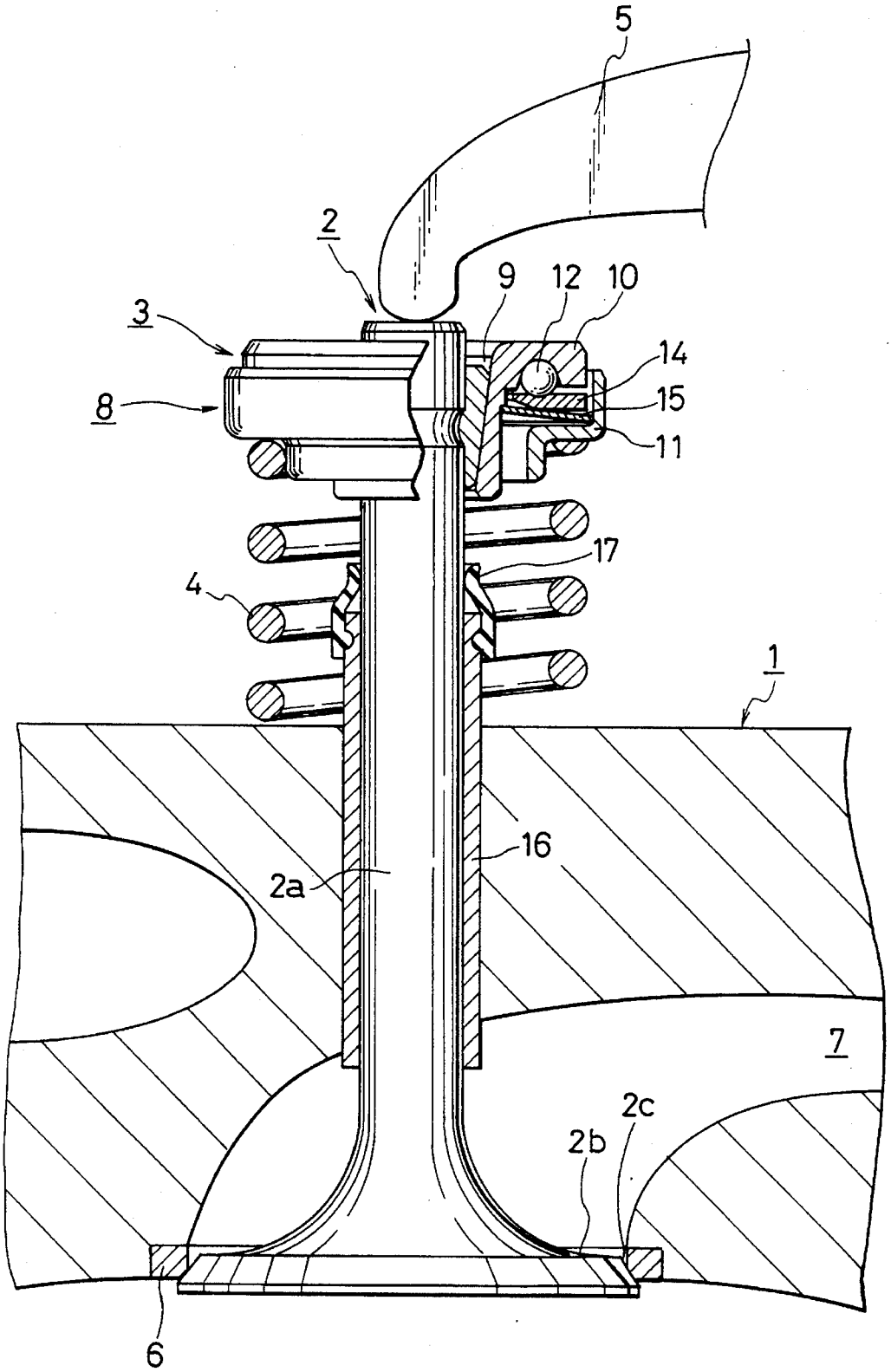
FIG. 9 PRIOR ART
FIG. 9 is a partially cut-away longitudinal sectional front view of a conventional rotator.
Figure 10:
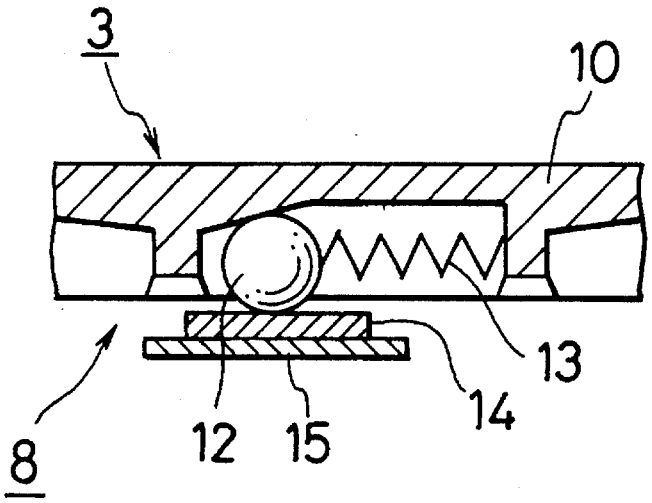
FIG.10 PRIOR ART
FIG. 10 is a partially longitudinal sectional front view of the main portion.

FIG. 8 illustrates the fifth embodiment, in which a retainer 63 and a suspending member 64 are separately formed, and a flange 64*a* of the suspending member 64 is provided between the retainer 63 and the upper end of the valve spring 4.

As mentioned above, when the retainer 63 and the suspending member 64 are separately formed, the retainer 63 is gradually rotated by frictional force between the upper surface of the flange 64*a* and the lower surface of the retainer 63 during rotation of the suspending member 64. It is thus advantageous to apply to a high speed automobile engine.

Guide means in this embodiment comprises a leaf spring slightly thinner than the standing member 66, and has an upper inclined guide surface 65*a*. An upper portion 65*a* is projected outwards from a lower portion 65*b* above a dotted line in FIG. 8. Several pieces of the guide means 65 are provided on the outer surface of the standing member 66 in a circumferential direction and are fixed. The adjacent guide means 65 are closely arranged, and the right end of the inclined guide surface 65*c* is connected to the lower portion 65*b* of right side guide means 65.

If the projection 68 is disposed on the inclined guide surface 65*c* and if the valve descends, the projection 68 is moved in a right oblique direction along the inclined guide surface and is positioned under the upper portion 65*a* of the right guide means 65.

With elevation of the valve 2, the projection 68 ascends and elastically bends the upper portion 65*a* of the guide means 65 inwardly and passes just over the upper portion 65*a*, and thereafter, similar action is repeated. Such guide means 65 enables the valve 2 to rotate only when the valve 2 descends and not to rotate when it ascends.

Various changes and modifications may be made as follows in addition to the above:

(1) The projections 27, 43 and 44 are provided on the inner surface of the standing member 22 and 45, the guide means 30 are provided on the outer surface of the suspending members 21 and 41.

(2) The inner diameters of the suspending members 21 and 41 are larger than the outer diameters of the standing members 22 and 45. The projections 27, 43 and 44 are provided on one of the suspending and standing members, and the guide means 30 and 40 are provided on the other.

(3) The standing member 22 is integrally formed with the cylinder head 1.

(4) By adjusting arrangement of the guide means 30 and 47 and the projections 27, 43 and 44, the valve 2 is rotated at the elevating end when the retainer 63 ascends.

The foregoings merely relate to embodiments of the present invention. Various modifications and changes may be made by persons skilled in the art without departing from the scope of claims wherein:

What is claimed is:

1. A valve rotator used in an engine in which a valve spring is provided between a cylinder head and a retainer which is engaged with a projecting end of a valve, the valve being actuated against the valve spring to open and close a port, the rotator comprising:

a suspending member which suspends from an outer circumference of the retainer; and a standing member which is concentric to the valve and extends from the cylinder head to the retainer, the standing and suspending members being at least partially overlapped, a projection being provided on one of the suspending and standing members at the overlapped portion, guide means which comprise an inclined guide surface being slidably engaged on said projection to cause relative rotation between the suspending and standing members wherein the guide means comprise a first protuberance which has an inclined guide surface which is slidably engaged with the projection when the retainer descends, and a second protuberance which has an inclined guide surface which slidably engaged with the projection when the retainer ascends.

2. A valve rotator for an engine in which a valve spring is provided between a cylinder head and a retainer which is engaged with a projecting end of a valve, the valve being actuated against a valve spring to open and close a port, the rotator comprising:

a suspending member which suspends from an outer circumference of the retainer; and a standing member which is concentric to the valve and extends from the cylinder head to the retainer, the standing and suspending members being at least partially overlapped, a projection being provided on one of the suspending and standing members at the overlapped portion, guide means which comprise an inclined guide surface being slidably engaged on said projection to cause relative rotation between the suspending and standing members wherein the projection comprises first and second projections, the guide means comprising a plurality of protuberances, each of which has a first inclined guide surface which is slidably engaged with the first projection when the retainer descends, and a second inclined guide surface which is slidably engaged with the second projection when the retainer ascends.

3. A valve rotator as defined in claim 2 wherein each of the protuberances is triangular, the suspending member comprising a plurality of arcuate plates which suspend from the retainer.

4. A valve rotator used in connection with an engine in which a valve spring is provided between a cylinder head and a retainer which is engaged with a projecting end of a valve, the valve being actuated against the valve spring to open and close a port, the rotator comprising:

a suspending member which suspends from an outer circumference of the retainer; and a standing member which is concentric to the valve and extends from the cylinder head to the retainer, the standing and suspending members being at least partially overlapped, a projection being provided on one of the suspending and standing members at the overlapped portion, guide means which comprise an inclined surface being slidably engaged on said projection to cause relative rotation between the suspending and standing members wherein the standing member is separately formed from the cylinder head and is provided on the cylinder head to be rotatable around the valve with certain frictional resistance.

5. A valve rotator for an engine in which a valve spring is provided between a cylinder head and a retainer which is engaged with a projecting end of a valve, the actuated against the valve spring to open and close a port, the rotator comprising:

a suspending member which suspends from an outer circumference of the retainer, and a standing member which is concentric to the valve and extends from the cylinder head to the retainer, the standing and suspending members being at least partially overlapped, a projection being provided on one of the suspending and standing members at the overlapped portion, guide means which comprise an inclined guide surface being slidably engaged on said projection to cause relative rotation between the suspending and standing members, wherein the standing member is separately formed from the cylinder head, rotation stopper means being provided between the standing member and the cylinder head to prevent rotation of the standing member around the valve and wherein the rotation stopper means comprise a protrusion of the cylinder head, and a groove of the standing member, the protrusion being engaged in the groove to prevent rotation of the standing member.

* * * * *